US005533669A

United States Patent [19]

Kokawa et al.

[11] Patent Number: 5,533,669

[45] Date of Patent: Jul. 9, 1996

[54] HEAT TRANSFER APPARATUS

[75] Inventors: Katsuzo Kokawa, Nara-ken; Katsuhiko Yamamoto, Nabari; Tatsuki Sakurabu, Nara; Satoshi Imabayashi; Muneo Tao, both of Yamatokoriyama, all of Japan

[73] Assignee: Matsushita Electric Industrial Co., Ltd., Osaka, Japan

[21] Appl. No.: 335,403

[22] Filed: Nov. 3, 1994

[51] Int. Cl.[6] ..... F24D 7/00

[52] U.S. Cl. ..... 237/1 SL; 237/16

[58] Field of Search ..... 237/1 SL, 16, 237/17, 60

[56] References Cited

U.S. PATENT DOCUMENTS

| | | | |
|---|---|---|---|
| 2,434,575 | 1/1948 | Marshall | 237/1 SL X |
| 4,060,194 | 11/1977 | Lutz | 237/1 SL |
| 4,921,166 | 5/1990 | Matsumoto et al. | 237/60 |

FOREIGN PATENT DOCUMENTS 3-51631 3/1991 Japan .

*Primary Examiner*—William E. Tapolcai
*Attorney, Agent, or Firm*—Wenderoth, Lind & Ponack

[57] ABSTRACT

A heat transfer apparatus is provided with a refrigerant heater, a single container disposed above the refrigerant heater, and the radiator spaced from the container. The container accommodates a partitioning plate for separating the inside of the container into a gas-liquid separating chamber and a liquid-receiving chamber, and a valve body for selectively opening and closing an opening defined in the partitioning plate is disposed within the container. The valve body is driven by an electrically operated driver mounted on the container. The heat transfer apparatus is also provided with a first group of pipes for communicating the refrigerant heater and the gas-liquid separating chamber, and with a second group of pipes for communicating the gas-liquid separating chamber, the radiator, and the liquid-receiving chamber. The refrigerant heater, the gas-liquid separating chamber, and the first group of pipes constitute a heating circuit, while the gas-liquid separating chamber, the radiator, the liquid-receiving chamber, the valve body, and the second group of pipes constitute a heat release circuit.

10 Claims, 15 Drawing Sheets

HEAT TRANSFER APPARATUS

BACKGROUND OF THE INVENTION

1. Field of the Invention

The present invention relates to a heat transfer apparatus utilizable in heating a room, for example, by circulating a refrigerant, such as halogenated hydrocarbon HCFC 22, heated by a heat source such as an oil or gas burner through a radiator by the utilization of changes in pressure of the refrigerant and its gravitational effect. More particularly, the present invention relates to a compact and inexpensive heat transfer apparatus having a simple construction and an increased reliability and also having an increased heat transfer efficiency.

2. Description of Related Art

A heat transfer apparatus of this kind is well known from Japanese Laid-open Patent Publication (unexamined) No. 3-51631 and will be described below with reference to FIGS. 1A and 1B.

The heat transfer apparatus shown therein comprises a container 1 made up of two members soldered to each other. The container 1 is disposed above a refrigerant heater 4 having a burner 19. An upper portion of the container 1 functions as a gas-liquid separating chamber 2, while a lower portion thereof functions as a reservoir for storing liquid refrigerant 3. The container 1 is fluid-connected with the refrigerant heater 4 via an inlet pipe 5 extending downwardly from a lower end of the container 1 to the refrigerant heater 4 and an outlet pipe 6 extending from the refrigerant heater 4 to the gas-liquid separating chamber 2 of the container 1, thus constituting a heating circuit. The opening of the outlet pipe 6 is positioned in an upper portion of the gas-liquid separating chamber 2.

The container 1 is also fluid-connected with a radiator 14 having a fan 15 via a gas feeding pipe 16 extending upwardly from an upper portion of the container 1, a liquid-return pipe 18, a second check valve 17, a liquid-receiving container 7 disposed above the container 1, and a liquid-dropping pipe 10 having a first check valve 11, thus constituting a heat release circuit.

A horn-shaped pipe 13A formed on the lower end of an equalizing pipe 13 has an opening within the container 1 and is disposed above the upper end of the outlet pipe 6. An upper end of the equalizing pipe 13 is communicated with the inlet of an electromagnetic valve 12. The outlet of the electromagnetic valve 12 is communicated with an upper portion of the liquid-receiving container 7. The upper portion of the liquid-receiving container 7 has a liquid-receiving chamber 8 defined therein and incorporating a porous sheet 9, while the lower portion thereof is formed into, or otherwise integrated with, the refrigerant-dropping pipe 10 accommodating the first check valve 11. The lower end of the dropping pipe 10 is communicated with the gas-liquid separating chamber 2 in the container 1. The equalizing pipe 13, the electromagnetic valve 12, and the dropping pipe 10 constitute a liquid refrigerant-dropping circuit.

The timing at which the electromagnetic valve 12 is opened or closed is controlled by a control section 22 based on an output signal from a burner combustion controller 20 for the burner 19 and that from a temperature detector 21 mounted on the outlet pipe 6.

In this construction, the liquid refrigerant 3 heated by the burner 19 flows into the container 1 in a mixed state of gas and liquid via the outlet pipe 6 and is then separated into gas refrigerant and liquid refrigerant within the container 1. The liquid refrigerant is stored in the container 1 and is then circulated to the refrigerant heater 4 via the inlet pipe 5. The gas refrigerant which has flowed into the gas-liquid separating chamber 2 from the refrigerant heater 4 is fed to the radiator 14 via the gas feeding pipe 16 and is cooled by the fan 15.

The gas refrigerant so cooled during its passage through the radiator 14 is condensed and subcooled by the radiator 14. When the electromagnetic valve 12 is closed at this time, the liquid-receiving chamber 8 is closed because the first check valve 11 is normally biased upwardly by a spring 11A. Thus, the refrigerant flow in the heat release circuit is cut off temporarily with the closure of the electromagnetic valve 12.

However, when the pressure of the subcooled liquid refrigerant attains a value slightly higher than that in the liquid-receiving chamber 8, the subcooled liquid refrigerant enters the liquid-receiving chamber 8 through the liquid-return pipe 18 and the second check valve 17. The liquid refrigerant which has entered the liquid-receiving chamber 8 is diffused by the porous plate 9, thus condensing the gas refrigerant in the liquid-receiving chamber 8. Consequently, the pressure in the liquid-receiving chamber 8 drops rapidly.

For example, assuming that saturated gas of 60° C. is present in the liquid-receiving chamber 8 and that liquid refrigerant (the degree of subcooling: 30° C.) in the radiator 14 flows into the liquid-receiving chamber 8 from the radiator 14, the pressure in the liquid-receiving chamber 8 drops by 5 to 6 $kg/cm^2G$ from a saturation pressure of $24kg/cm^2G$ (HCFC 22) of 60° C.

As a result, the liquid refrigerant in the radiator 14 is sucked and fed into the liquid-receiving chamber 8 having a reduced pressure, thus filling the liquid-receiving chamber 8. When the electromagnetic valve 12 is subsequently opened upon the passage of a predetermined time, the gas-liquid refrigerant jetted from the outlet pipe 6 is introduced into the liquid-receiving chamber 8. Due to the gravitational effect of the refrigerant and the dynamic pressure component generated by the gas flow of the gas-liquid refrigerant from the outlet pipe 6, the liquid refrigerant in the liquid-receiving chamber 8 flows into the container 1 via the first check valve 11 then opened against the urging force of the spring 11A. At this time, the second check valve 17 is in a closed state because the pressure in the liquid-receiving chamber 8 is high.

When the electromagnetic valve 12 is closed a predetermined time after the opening thereof, the pressure in the liquid-receiving chamber 8 drops. As a result, the first check valve 11 is closed by the urging force of the spring 11A and the subcooled liquid refrigerant in the radiator 14 is then introduced into the liquid-receiving chamber 8 to fill up the liquid-receiving chamber 8 with the liquid refrigerant. The electromagnetic valve 12 is opened when a predetermined time has elapsed.

The foregoing cycle of operation is repeated. That is, the heating circuit including the refrigerant heater 4 transfers heat by a natural circulation mode, whereas the heat release circuit including the radiator 14 transfers heat by an intermittent mode.

In the above construction, the amount G (kg/h) of refrigerant circulated is expressed as follows:

$$G=(V\times\gamma\times3600)/(T\times1000) \quad (1)$$

where V is the volume (cc) of the liquid-receiving chamber; $\gamma$ is the density (g/cc) of the liquid refrigerant in the liquid-receiving chamber; and T is the cycle (open time+closed time) (sec) of opening and closure of the electromagnetic valve.

The amount Q (kcal/h) of heat transfer is expressed as follows:

$$Q=\Delta i \times G \quad (2)$$

where Δi (kcal/kg) is the difference between the enthalpy of refrigerant at the inlet of the radiator 14 and that of refrigerant at the outlet thereof.

The cycle T is found as follows from equations (1) and (2) above:

$$T=(\Delta i \times V \times \gamma \times 3600)/(Q \times 1000) \quad (3)$$

From the above, the cycle T is proportional to Δi and inversely proportional to the combustion amount of the burner 19, namely, the amount Q of heat transfer. This indicates that it is necessary to adjust the amount G of refrigerant circulation according to the amount of combustion so that the cycle T may become short when the amount of combustion is large, and the cycle T may become long when the amount of combustion is small. Due to the characteristic of the refrigerant, Δi becomes small when the pressure in the radiator 14 is high, whereas Δi becomes large when the pressure in the radiator 14 is low. Therefore, it is also necessary to adjust the amount G of refrigerant circulation in accordance with the pressure in the radiator 14 as well, so that the cycle T may become short when the pressure in the radiator 14 is high, and the cycle T may become long when the pressure in the radiator 14 is low.

To this end, based on an output signal from the controller 20 for controlling the amount of combustion and that from the temperature detector 21 mounted on the outlet pipe 6 through which the gas-liquid refrigerant having a correlation between the pressure and temperature thereof flows, the timing at which the electromagnetic valve 12 is opened or closed is controlled by the control section 22.

The conventional heat transfer apparatus having the above construction has, however, the following problems in heat transfer performance:

(1) As described above, the conventional heat transfer apparatus is such that the refrigerant in a mixed state of gas and liquid jetted from the outlet pipe 6 is introduced into the liquid-receiving chamber 8, with the electromagnetic valve 12 opened, and the liquid refrigerant stored in the liquid-receiving chamber 8 is dropped into the container 1 by the dynamic pressure component generated by the gas-liquid refrigerant jetted from the outlet pipe 6 in addition to the gravitational effect of the liquid refrigerant.

However, when the liquid refrigerant is dropped into the container 1, the refrigerant containing a liquid component is introduced into the liquid-receiving chamber 8 via the equalizing pipe 13. Thus, when the electromagnetic valve 12 is subsequently closed and when the first check valve 11 is closed by the spring 11A, the liquid refrigerant remains in the liquid-receiving chamber 8, thus reducing the effective volume of the liquid-receiving chamber 8 and the amount of refrigerant to be fed from the radiator 14 to the liquid-receiving chamber 8.

(2) When the subcooled liquid refrigerant flows into the radiator 14 from the liquid-receiving chamber 8 and if warm liquid refrigerant remains in the liquid-receiving chamber 8, the cooling capability of the subcooled liquid refrigerant is used to condense the gas refrigerant in the liquid-receiving chamber 8 to thereby reduce the pressure inside the liquid-receiving chamber 8, and is also used to lower the temperature of the liquid refrigerant which has remained therein. Therefore, the pressure in the liquid-receiving chamber 8 cannot be reduced greatly and, hence, it takes a long time to suck the liquid refrigerant into the liquid-receiving chamber 8 from the radiator 14.

Further, because opposite ends of the refrigerant-dropping pipe 10 are soldered or welded to the liquid-receiving chamber 8 and to the container 1, it is necessary to lengthen the refrigerant-dropping pipe 10 to prevent a thermal deformation of the first check valve 11 during soldering or welding. Because of this, the resistance to the flow of the liquid refrigerant is high and, hence, it takes a long time to drop the liquid refrigerant from the liquid-receiving chamber 8 to the container 1.

For these reasons, the conventional heat transfer apparatus is incapable of transferring a large quantity of heat.

(3) It is to be noted that the heat release performance can be maximized and the required amount of circulation of the refrigerant can be minimized if only the gas refrigerant from the gas-liquid separating chamber 2 is introduced into the radiator 14 to accomplish a heat exchange of latent heat.

In the conventional heat transfer apparatus, however, the gas-liquid refrigerant jetted from the outlet pipe 6 of the refrigerant heater 4 is directed upwardly and subsequently downwardly in synchronization with the opening and subsequent closure of the electromagnetic valve 12. As a result, droplets scatter in the gas-liquid separating chamber 2, thus forming a turbulent flow. The droplets eventually enter the gas feeding pipe 16 and circulate through the heat release circuit. This reduces the heat exchange efficiency and increases the amount of refrigerant contained in the entire apparatus. Further, it is necessary to circulate refrigerant that does not contribute to heat exchange of latent heat to be performed by the radiator 14.

Furthermore, the liquid refrigerant-dropping circuit is positioned above the container 1, and opposite ends of the refrigerant-dropping pipe 10 are joined to the liquid-receiving chamber 8 and to the container 1. Thus, it is necessary to provide the long refrigerant-dropping pipe 10 to prevent heat generated during joining from deforming the first check valve 11, resulting in an increase in height from the bottom of the container 1 to the top of the electromagnetic valve 12.

Accordingly, the conventional heat transfer apparatus cannot be made compact, requires a considerable number of parts, and has many portions to be joined. Thus, the cost of manufacturing the apparatus is high.

SUMMARY OF THE INVENTION

The present invention has been developed to overcome the above- described disadvantages.

It is accordingly an objective of the present invention to provide an improved heat transfer apparatus capable of shortening the period of time (one cycle) necessary for sucking subcooled liquid refrigerant from a radiator into a liquid-receiving chamber by effectively using the volume of the liquid-receiving chamber and also for dropping the liquid refrigerant from the liquid-receiving chamber to a gas-liquid separating chamber.

Another objective of the present invention is to provide a heat transfer apparatus capable of increasing the heat transfer performance by efficiently separating the refrigerant flowing into the radiator into gas refrigerant and liquid refrigerant.

A further objective of the present invention is to provide the heat transfer apparatus of the above-described type which has a small and compact construction and can be manufactured at a low cost.

In accomplishing the above and other objectives, the heat transfer apparatus according to the present invention comprises a refrigerant heater, a first container disposed above the refrigerant heater and having a gas-liquid separating chamber defined therein, and a second container directly joined to an upper portion of the first container and having a liquid-receiving chamber defined therein. An opening defined between the first and second containers is selectively opened and closed by a valve body driven by a driving means. The heat transfer apparatus also comprises a radiator spaced from the first container, a first communication means for communicating the refrigerant heater and the gas-liquid separating chamber, and a second communication means for communicating the gas-liquid separating chamber, the radiator, and the liquid-receiving chamber. The refrigerant heater, the gas-liquid separating chamber, and the first communication means constitute a heating circuit, while the gas-liquid separating chamber, the radiator, the liquid-receiving chamber, the valve body, and the second communication means constitute a heat release circuit.

Alternatively, the heat transfer apparatus may have a single container disposed above the refrigerant heater. In this case, the container includes a partitioning plate accommodated therein to thereby separate the inside thereof into a gas-liquid separating chamber and a liquid-receiving chamber and having defined therein an opening adapted to be selectively opened and closed by the valve body.

Conveniently, the first communication means comprises a first pipe to allow refrigerant to flow from the refrigerant heater to the gas-liquid separating chamber, and the second communication means comprises a second pipe to allow the refrigerant to flow from the gas-liquid separating chamber to the radiator. The first and second pipes are open in the gas-liquid separating chamber and have respective openings higher than the valve body.

Advantageously, the driving means has an electrically vertically movable shaft to open the opening of the partitioning plate.

The heat transfer apparatus may include a bypass pipe and a bypass valve both mounted on the container for communicating the gas-liquid separating chamber and the liquid-receiving chamber with each other. The bypass valve and the driving means are controlled in synchronism with each other by a controller.

Alternatively, only the bypass pipe may be mounted on the container with the bypass valve accommodated in the driving means.

The valve body may have a pilot valve accommodated therein to selectively open and close an opening defined in the valve body. In this case, the driving means drives both the pilot valve and the valve body.

Advantageously, a heat insulation member is overlaid on the partitioning plate.

Preferably, the heat transfer apparatus includes a pressure detector for detecting the pressure inside the liquid-receiving chamber and a controller for controlling the driving means in response to an output signal from the pressure detector.

The pressure detector may detect the pressure inside a third pipe which communicates the radiator and the liquid-receiving chamber with each other.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

Figure 1A:
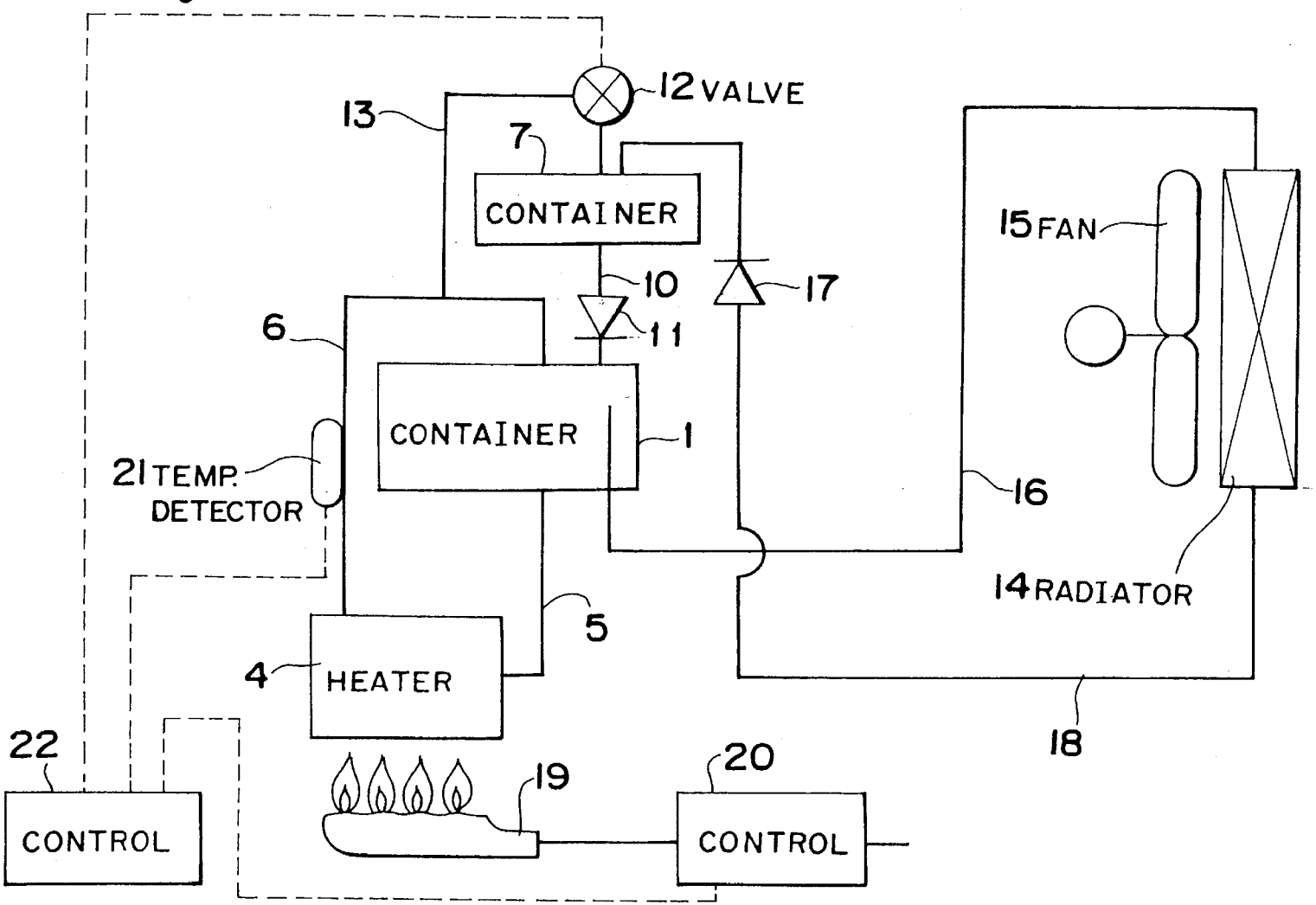
Fig. 1A PRIOR ART
FIG. 1A is a block diagram of a conventional heat transfer apparatus.
Figure 1B:
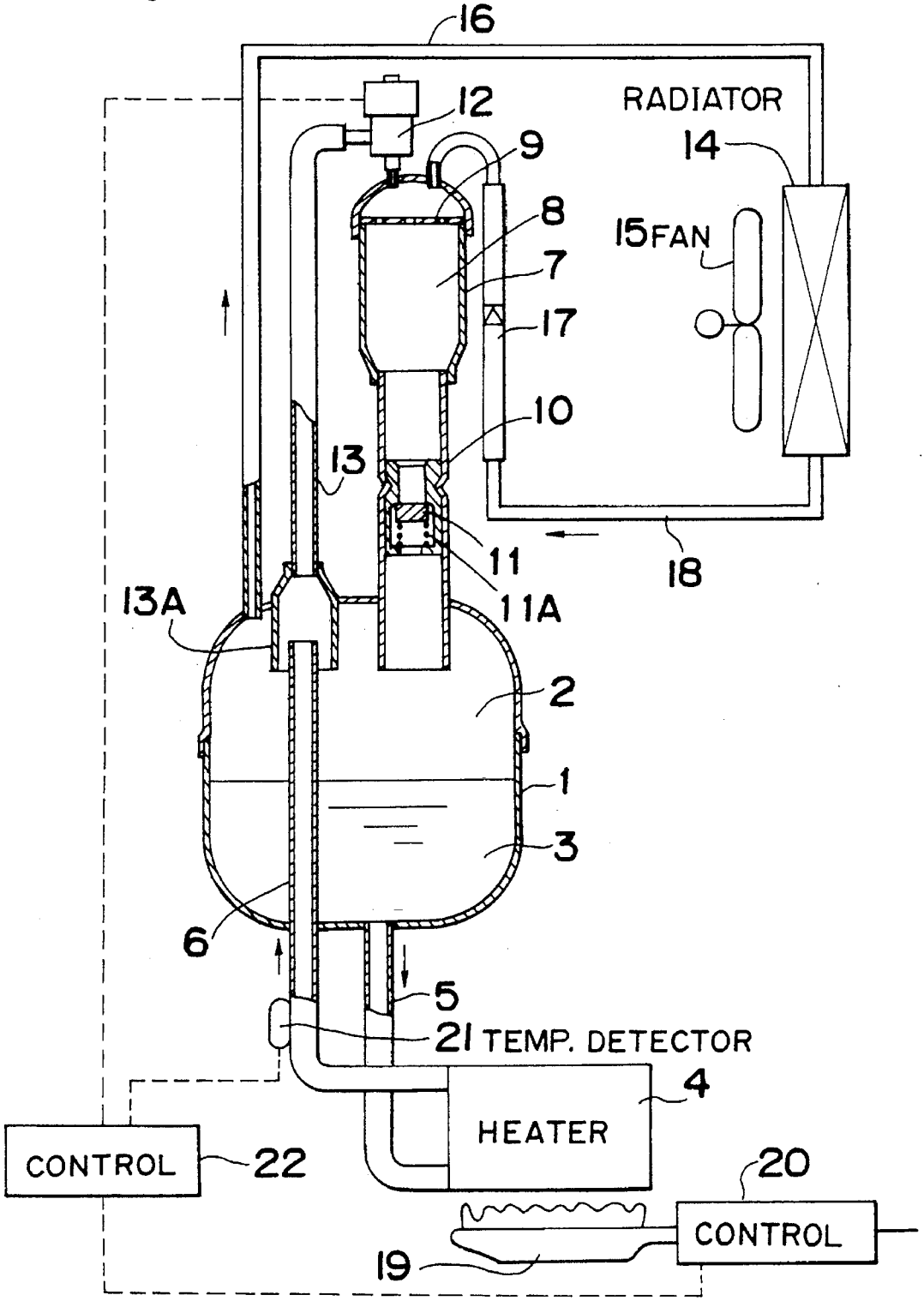
Fig. 1B PRIOR ART
FIG. 1B is a schematic longitudinal sectional view showing the construction of the conventional heat transfer apparatus shown in FIG. 1A.
Figure 2:
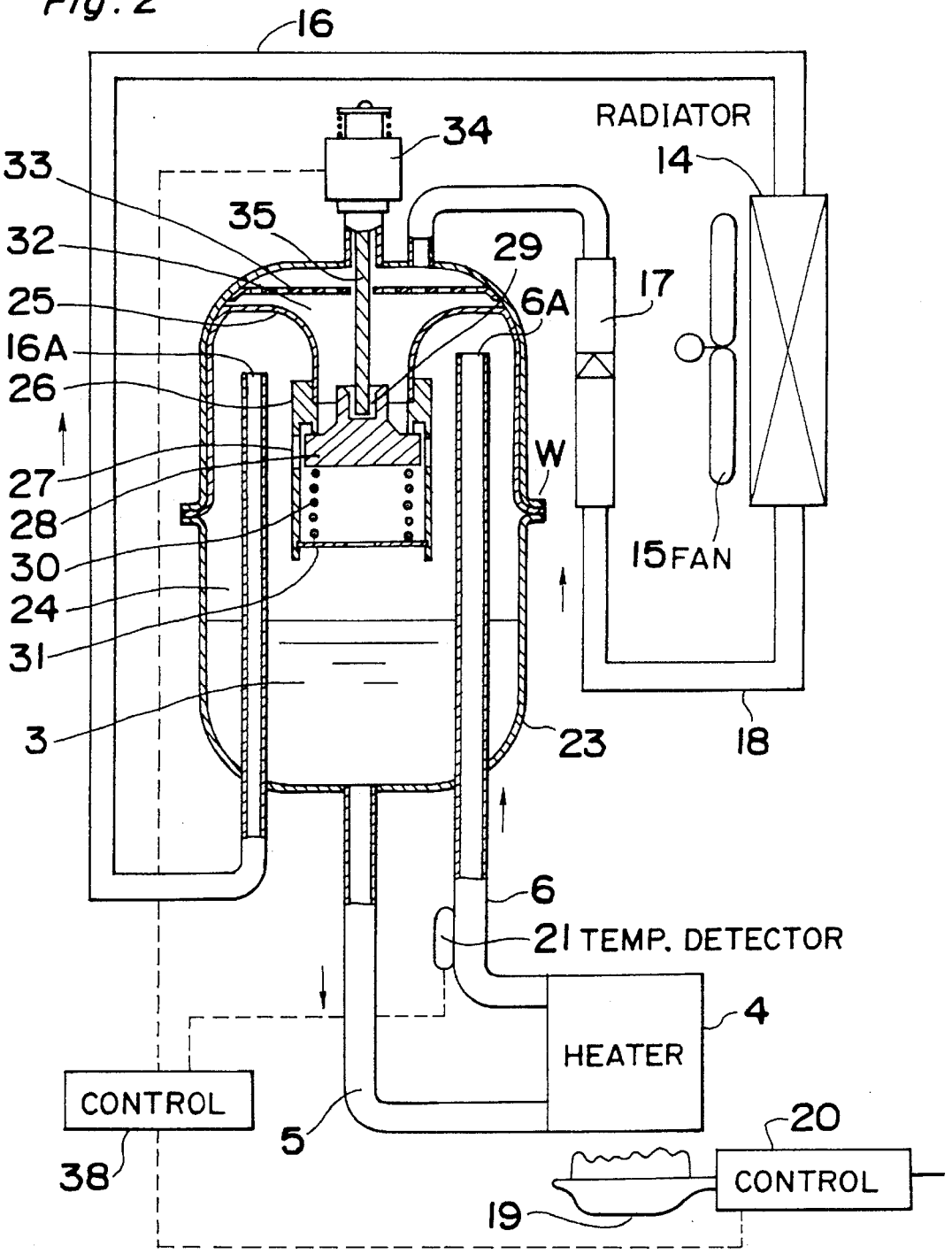
FIG. 2 is a schematic longitudinal sectional view showing the construction of a heat transfer apparatus according to a first embodiment of the present invention.

A heat transfer apparatus according to a first embodiment of the present invention is described below with reference to FIGS. 2 through 5.

A container 23 accommodating a quantity of refrigerant 3 and a valve body 28 is made tip of generally bowl-shaped upper and lower members connected together by welding flanges W thereof, with a partitioning plate 25 interposed between the tipper and lower members. The container 23 has a gas-liquid separating chamber 24 defined therein below the partitioning plate 25 and a liquid-receiving chamber 32 defined therein above the partitioning plate 25. The gas-liquid separating chamber 24 stores the refrigerant 3 at a lower portion thereof, while the liquid-receiving chamber 32 accommodates a generally horizontally extending porous plate 33 formed therein and communicates with the gas-liquid separating chamber 24 via the valve body 28.

The liquid refrigerant 3 in the gas-liquid separating chamber 24 is supplied to a refrigerant heater 4 via an inlet pipe 5 and is heated by a burner 19. The heated refrigerant 3 is partially vaporized and fed to the gas-liquid separating chamber 24 in a mixed state of gas and liquid through an outlet pipe 6, and is jetted from an opening 6A of the outlet pipe 6. The gas-liquid separating chamber 24, the refrigerant heater 4, the inlet pipe 5, and the outlet pipe 6 constitute a heating circuit.

The liquid refrigerant 3 is stored in the lower portion of the gas-liquid separating chamber 24, while the gas refrigerant enters an opening 16A of a gas feeding pipe 16 and is fed to a radiator 14 through the gas feeding pipe 16. The gas refrigerant 3 is then cooled and liquefied by a fan 15, and is further cooled to a subcooled state. The subcooled refrigerant is fed to the liquid-receiving chamber 32 at a portion above the porous plate 33 via a liquid-return pipe 18 and a second check valve 17. The gas-liquid separating chamber 24, the gas feeding pipe 16, the radiator 14, the liquid-return pipe 18, and the liquid-receiving chamber 32 constitute a heat release circuit.

A driving means 34, mounted on the upper end of the container 23, has a shaft 35 extending downwardly therefrom. The shaft 35 has an outer diameter smaller than the inner diameter of a recess 29 defined in an upper portion of the valve body 29, and the lower end of the shaft 35 is received in the recess 29 such that, when the shaft 35 is lowered so as to contact the valve body 28, the latter can be opened, it being however that the shaft 35 is normally biased upwardly by the action of a biasing spring 36A as will be described later to close the valve body 28.

Figure 4:
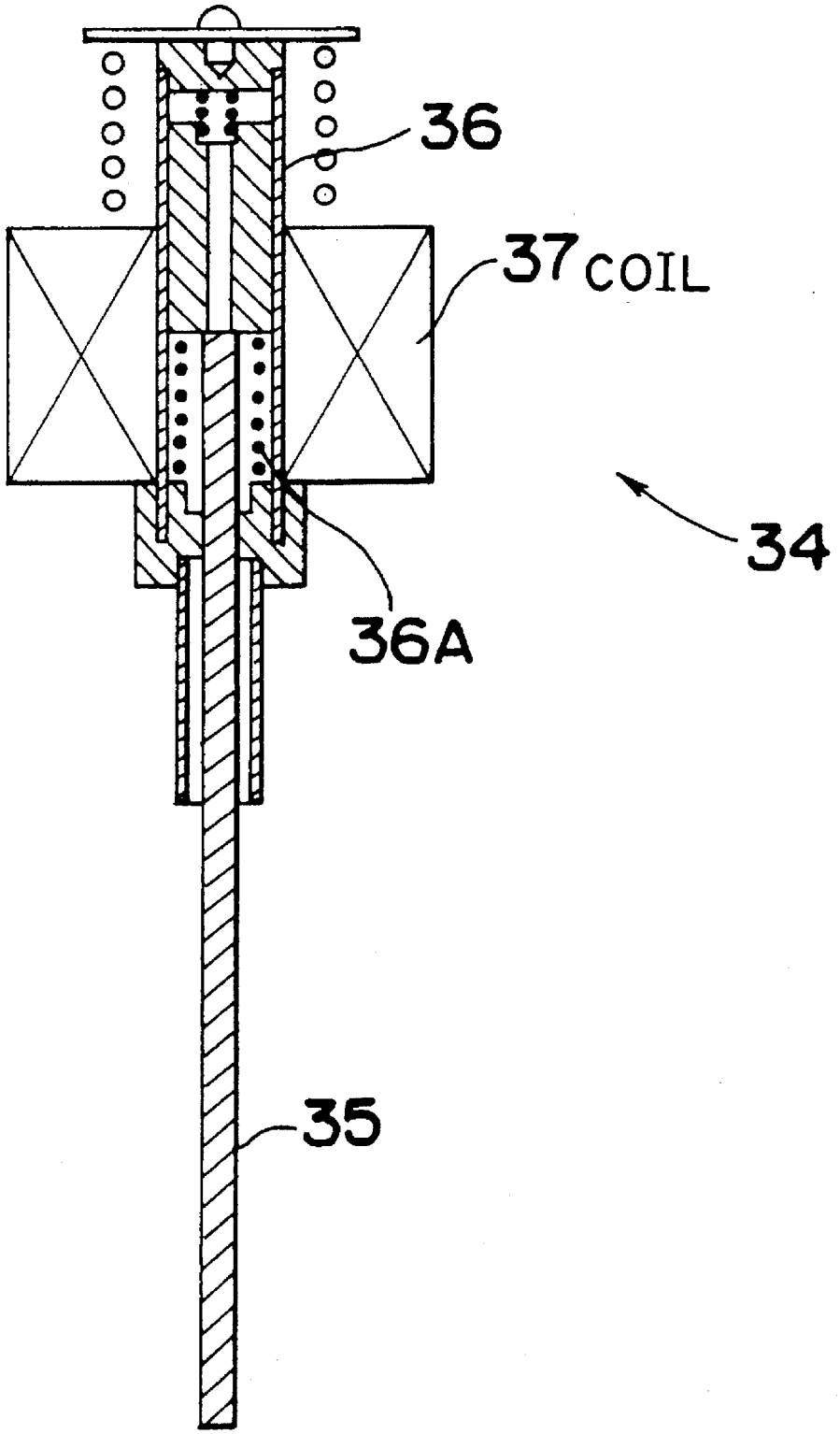
FIG. 4 is a longitudinal sectional view of a driving means mounted on the container of the heat transfer apparatus of FIG. 2.

Referring to FIG. 4, the details of the driving means 34 are shown. As shown therein, the driving means 34 includes an electric coil 37 which, when electrically energized, attracts a plunger 36 to allow the latter to push the shaft 35 downwardly, but which when deenergized, allows the plunger 36 to be upwardly biased by the action of the spring 36A, accompanied by a corresponding upward shift of the shaft 35.

The ON duration during which the coil 37 of the driving means 34 is electrically energized and the OFF duration during which the coil 37 is electrically deenergized are controlled by a control means 38 to assume respective predetermined lengths of time determined in reference to output signals generated respectively from a combustion controller 20 operable to control the burning amount of the burner 19 and a temperature detector 21 disposed on the outlet pipe 6.

During the OFF duration of the coil 37, that is, during a period in which the coil 37 is deenergized, the shaft 35 is upwardly shifted together with the plunger 35 then upwardly urged by the spring 36A and, hence, a spring 30 urges the valve body 28 upwards with the valve body 28 consequently seated against a valve seat of a valve guide 26. Therefore, when the pressure of the subcooled liquid refrigerant attains a value slightly higher than that in the liquid-receiving chamber 32, the subcooled liquid refrigerant enters the liquid-receiving chamber 32 via the liquid-return pipe 18 and the second check valve 17. The liquid refrigerant which has entered the liquid-receiving chamber 32 is scattered by the porous plate 33 to condense the vaporized refrigerant in the liquid-receiving chamber 32, resulting in a rapid drop of the pressure in the liquid-receiving chamber 32. Consequently, the liquid refrigerant inside the radiator 14 is sucked into the liquid-receiving chamber 32 having a reduced pressure, thus filling the liquid-receiving chamber 32.

Figure 3:
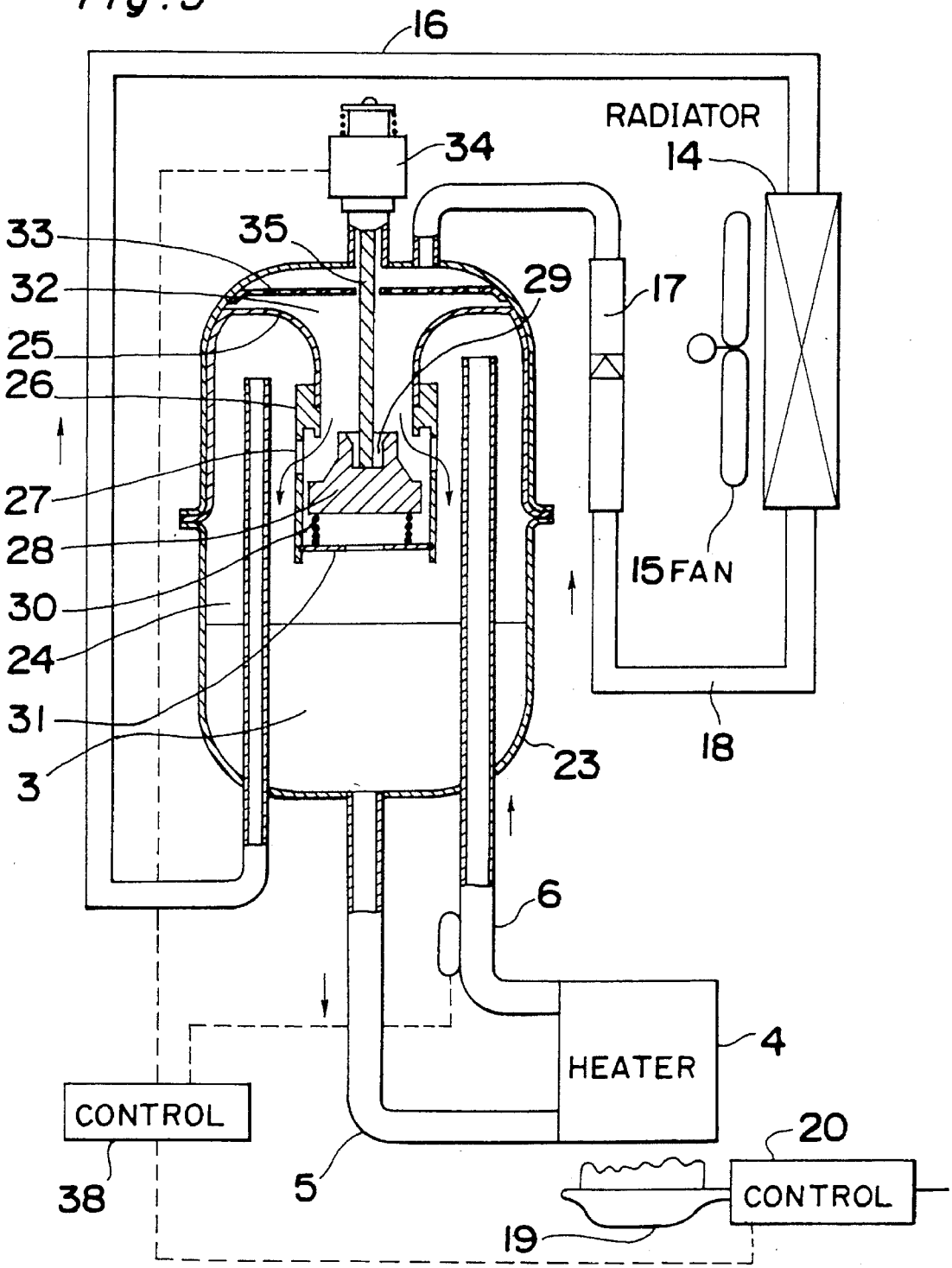
FIG. 3 is a view similar to FIG. 2, but indicating the condition in which a valve body accommodated in a container is open.

Upon the lapse of a certain period of time, the driving means 34 is energized for a predetermined period of time. Energization of the driving means 34 results in a downward shift of the shaft 35 to engage it with the valve body 28, thus causing the latter to open. Consequently, as shown in FIG. 3, gas-liquid replacement is performed in the liquid-receiving chamber 32, with the result that the liquid refrigerant in the liquid-receiving chamber 32 drops to the gas-liquid separating chamber 24 via gas-liquid replacement holes 27 by its own gravity and is reserved therein as the liquid refrigerant 3. When the driving means 34 is subsequently deenergized, the spring 36A presses the plunger 36 and, hence, the shaft 35 upwardly, allowing the spring 30 to upwardly bias the valve body 28 until the valve body 28 is seated against the valve seat of the valve guide 26. Consequently, the subcooled liquid refrigerant flows from the radiator 14 into the liquid-receiving chamber 32, thus filling the liquid-receiving chamber 32.

Again after a predetermined period of time, the driving means 34 is energized to open the valve body 28. In this manner, the valve body 28 is selectively opened and closed repeatedly. That is, the heating circuit including the gas-liquid separating chamber 24 and the refrigerant heater 4 constitutes a natural circulation mode, while the heat release circuit including the radiator 14 transfers heat by an intermittent rood&.

Figure 5:
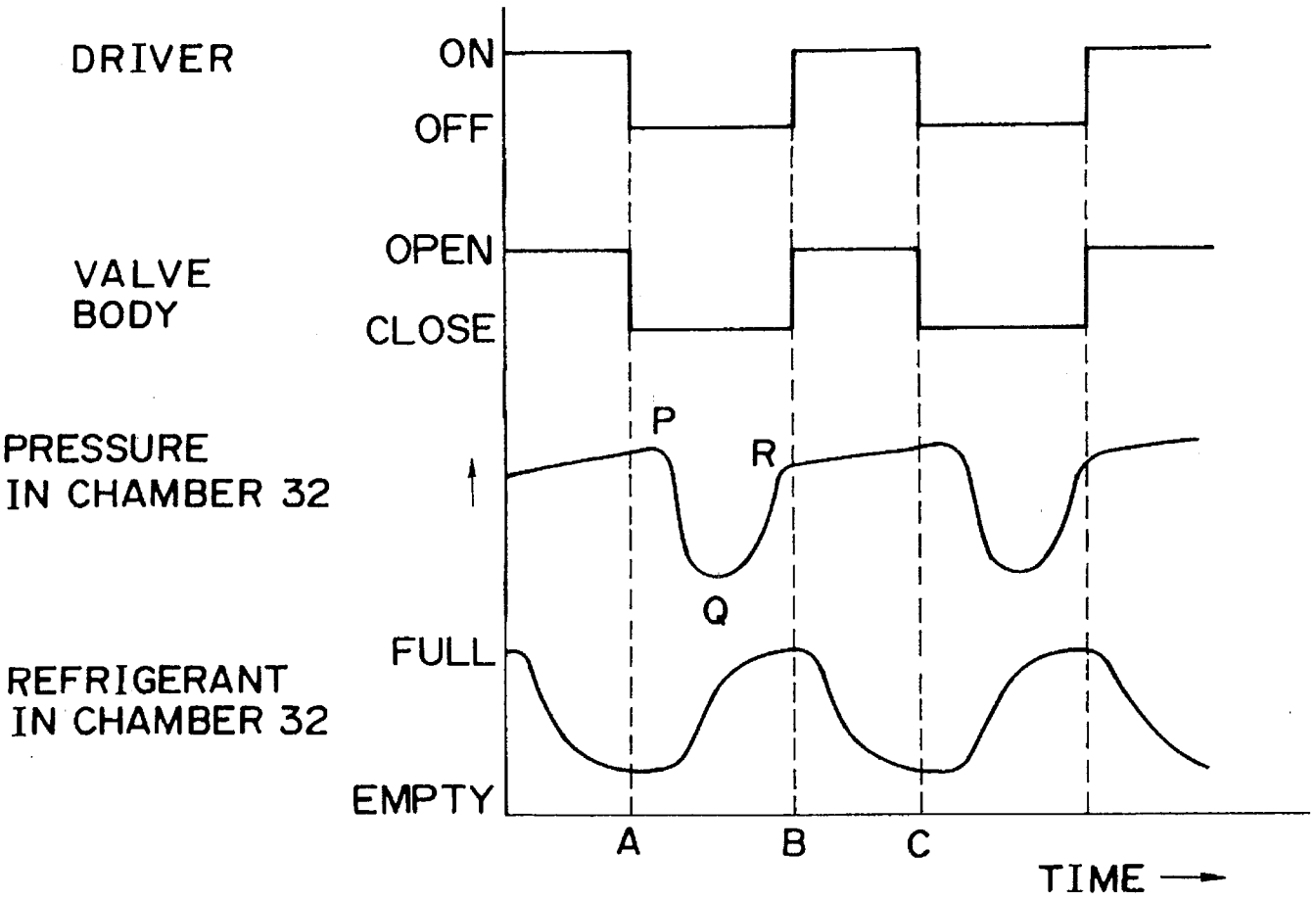
FIG. 5 is a graph showing the operation of the heat transfer apparatus of FIG. 2.

FIG. 5 shows the pattern of change in pressure inside the liquid-receiving chamber 32 and the pattern of change in amount of the liquid refrigerant in the liquid-receiving chamber 32 with respect to the operation of the driving means 34 and that of the valve body 28. At a point (A) at which the driving means 34 is electrically deenergized, the valve body 28 is closed. Immediately before the point (A), the liquid refrigerant stored in the liquid-receiving chamber 32 in the previous cycle is dropped into the gas-liquid separating chamber 24. Thus, at the point (A), the liquid refrigerant is not present in the liquid-receiving chamber 32, but the gas refrigerant is present therein. In this state, the subcooled liquid refrigerant discharged from the radiator 14 is introduced into the liquid-receiving chamber 32, thus condensing the gas refrigerant in the liquid-receiving chamber 32. As a result, the pressure in the liquid-receiving chamber 32 drops rapidly from a value, indicated by a point (P), to a value indicated by a point (Q). With the pressure drop, the liquid refrigerant in the radiator 14 is sucked into the liquid-receiving chamber 32, thereby increasing the quantity of the liquid refrigerant in the liquid-receiving chamber 32 to fill up the latter. As a result, the liquid refrigerant does not flow from the radiator 14 to the liquid-receiving chamber 32 via the liquid-return pipe 18 and, consequently, the pressure in the liquid-receiving chamber 32 rises to a value shown by a point (R).

When the driving means 34 is again electrically energized for a predetermined time from a point (B) to a point (C) subsequent to the OFF duration from the point (A) to the point (B) at which the driving means 34 is electrically deenergized, the valve body 28 is again opened to permit the liquid refrigerant contained in the liquid-receiving chamber 32 to drop into the gas-liquid separating chamber 24. Therefore, the quantity of the liquid refrigerant is zero at the point (C) and only the gas refrigerant is present in the liquid-receiving chamber 32. In accordance with the change in operation of the driving means 34 and the valve body 28, the pressure inside the liquid-receiving chamber 32 and the quantity of the liquid refrigerant change repeatedly, as discussed above.

In order to adjust the quantity of the refrigerant to be circulated according to the burning amount of the burner 19 and the pressure in the radiator 14 for the reason described previously, the OFF duration from the point (A) to the point (B) and the ON duration from the point (B) to the point (C) are controlled by the control means 38 based on an output signal from the temperature detector 21 capable of indirectly detecting the pressure inside the radiator 14 and an output signal of the combustion controller 20.

The effect of the heat transfer apparatus according to the first embodiment will now be described.

Since the valve body 28 is disposed inside the container 23, not only can the vertical length from the bottom of the container 23 to the upper end of the driving means 34 be reduced advantageously, but the number of parts and portions to be joined to each other can also be reduced, thus improving the reliability of the heat transfer apparatus and reducing its cost. Further, when the valve body 28 is closed after the liquid refrigerant 3 is dropped into the gas-liquid separating chamber 24, only the refrigerant of saturated gas stays inside the liquid-receiving chamber 32, unlike the conventional heat transfer apparatus in which a mixture of the gas refrigerant and the liquid refrigerant stays in the liquid-receiving chamber. Therefore, in sucking the liquid refrigerant into the liquid-receiving chamber 32 from the radiator 14, the volume of the liquid-receiving chamber 32 can be effectively utilized, i.e., a greater amount of the liquid refrigerant can be sucked into the liquid-receiving chamber 32, increasing the amount of circulation of the refrigerant. As a result, a greater amount of heat can be transferred.

When the liquid refrigerant has been dropped into the gas-liquid separating chamber 24, the liquid refrigerant is not left in the liquid-receiving chamber 32. Thus, the subcooled liquid refrigerant introduced from the radiator 14 into the liquid-receiving chamber 32, which refrigerant has hitherto cooled high-temperature liquid refrigerant left in the liquid-receiving chamber 32, effectively condenses the gas refrigerant present in the liquid-receiving chamber 32. As a result, the pressure in the liquid-receiving chamber 32 can be greatly reduced so that the liquid refrigerant can be sucked into the liquid-receiving chamber 32 from the radiator 14 within a short period of time. Further, the provision of the valve body 28 inside the container 23 eliminates the necessity of a refrigerant-dropping pipe having a great resistance to the flow of the liquid refrigerant, thus greatly reducing the resistance to the flow of the liquid refrigerant from the liquid-receiving chamber 32 to the gas-liquid separating chamber 24. As a result, the liquid refrigerant can be dropped in a shorter period of time. This construction shortens the period of time (one cycle) necessary for sucking the liquid refrigerant from the radiator 14 to the liquid-receiving chamber 32 and dropping it to the gas-liquid separating chamber 24, and hence, the amount of circulation of the refrigerant can be increased, thus increasing the heat transfer performance.

Also, unlike the conventional heat transfer apparatus, the gas-liquid refrigerant jetted from the outlet pipe 6 of the refrigerant heater 4 is not directed upwardly and downwardly alternately depending on the operation of the valve body 28. According to the present invention, of the gas-liquid refrigerant, the liquid component is assuredly dropped along the partitioning plate 25. At this moment, because the opening 6A of the outlet pipe 6 of the refrigerant heater 4 and the opening 16A of the gas feeding pipe 16 are positioned above the valve body 28, atmosphere in the vicinity of the openings 6A and 16A is not disturbed by the gas refrigerant dropped from the liquid-receiving chamber 32 even when the valve body 28 is opened. Thus, the refrigerant inside the gas-liquid separating chamber 24 can be favorably separated into the gas refrigerant and the liquid refrigerant, and only a small amount of liquid refrigerant is discharged from the gas-liquid separating chamber 24 to the radiator 14. Accordingly, only the refrigerant condensed by the radiator 14 can be sucked into the liquid-receiving chamber 32, with the result that the amount of circulation of the refrigerant contributing to a heat exchange of latent heat can be increased, thus increasing the amount of heat transfer.

Moreover, because the valve body 28 is opened by bringing the shaft 35 of the driving means 34 received in the recess 29 of the valve body 28 into contact with the valve body 28, the valve body 28 provides a desired sealing performance when the valve body 28 is in the closed state, even though the driving means 34 is somewhat tilted due to an error during assemblage, thus ensuring the opening and closing operation of the valve body 28 and enabling the liquid refrigerant inside the liquid-receiving chamber 32 to stably drop to the gas-liquid separating chamber 24.

Figure 6:
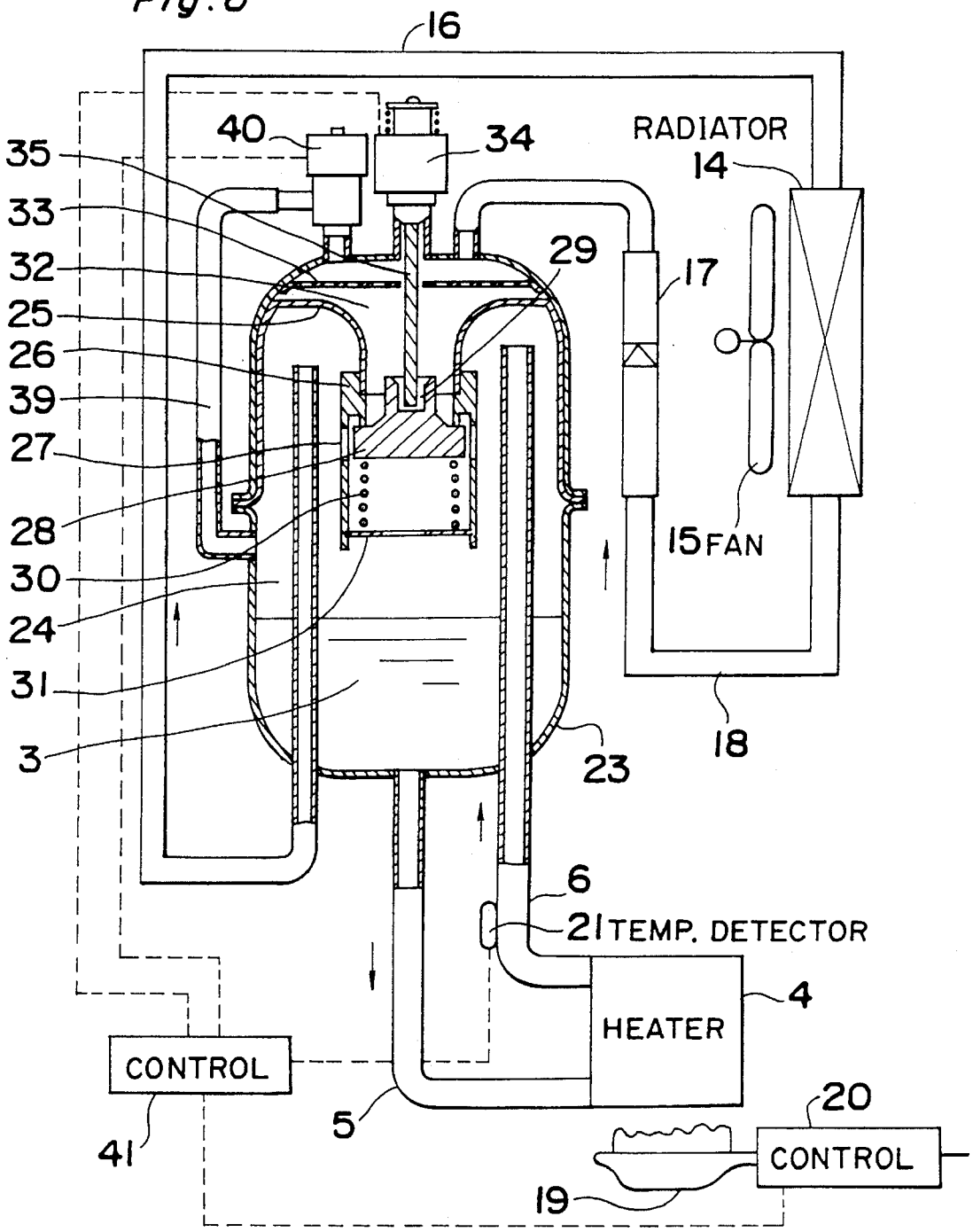
FIG. 6 is a view similar to FIG. 2, but according to a second embodiment of the present invention.

FIG. 6 depicts a heat transfer apparatus according to a second embodiment of the present invention. The heat transfer apparatus according to the second embodiment differs from that according to the first embodiment in that the former is provided with a bypass pipe 39 which communicates the gas-liquid separating chamber 24 with the upper portion of the liquid-receiving chamber 32 above the porous plate 33 via a bypass valve 40, and in that the former is also provided with a control means 41 for controlling the operation of the driving means 34 and that of the bypass valve 40 based on an output signal from the combustion controller 20 and that from the temperature detector 21 provided on the outlet pipe 6.

In the above construction, liquid refrigerant contained in the refrigerant heater 4 and heated by the burner 19 is fed, as gas-liquid refrigerant, to the gas-liquid separating chamber 24 via the outlet pipe 6, and is separated into gas refrigerant and liquid refrigerant in the gas-liquid separating chamber 24. The liquid refrigerant is stored in the lower portion of the gas-liquid separating chamber 24 and is fed to the refrigerant heater 4 via the inlet pipe 5. The gas refrigerant present in the upper portion of the gas-liquid separating chamber 24 is fed, via the gas feeding pipe 16, to the radiator 14, in which the gas refrigerant is condensed and subcooled by the fan 15.

When the bypass valve 40 is closed and the driving means 34 is deenergized, the spring 36A keeps the shaft 35 at the upper position. Thus, the valve body 28 is in contact with the valve seat of the valve guide 26. Therefore, when the pressure of the subcooled liquid refrigerant becomes a little higher than that in the liquid-receiving chamber 32, the subcooled liquid refrigerant enters the liquid-receiving chamber 32 via the liquid-return pipe 18 and the second check valve 17. The liquid refrigerant which has entered the liquid-receiving chamber 32 is diffused by the porous plate 33, thus condensing the gas refrigerant. Consequently, the pressure in the liquid-receiving chamber 32 drops rapidly. As a result, the liquid refrigerant in the radiator 14 is sucked into the liquid-receiving chamber 32 having a reduced pressure, thus filling up the liquid-receiving chamber 32.

When the driving means 34 is subsequently energized with the bypass valve 40 open, the shaft 35 is brought into contact with the valve body 28, thus opening the valve body 28. Consequently, the liquid refrigerant in the liquid-receiving chamber 32 drops into the gas-liquid separating chamber 24 via the gas-liquid replacement holes 27 defined in the valve guide 26 by its own gravity as well as a gas-liquid replacing action of the gas flow introduced from the gas-liquid separating chamber 24 to the bypass pipe 39. Such liquid refrigerant is eventually stored in the gas-liquid separating chamber 24 as the liquid refrigerant 3. When the bypass valve 40 is closed and the driving means 34 is deenergized, the spring 36A presses the shaft 35 upwardly and, hence, the spring 30 presses the valve body 28 upwardly, thus bringing it into contact with the valve seat of the valve guide 26. That is, the valve body 28 is forced into the closed state. Consequently, the subcooled liquid refrigerant in the radiator 14 flows into the liquid-receiving chamber 32, thus filling up the liquid-receiving chamber 32.

Thereafter, the bypass valve 40 is opened and the driving means 34 is energized to open the valve body 28. The opening and closing operations are repeatedly performed.

Figure 7:
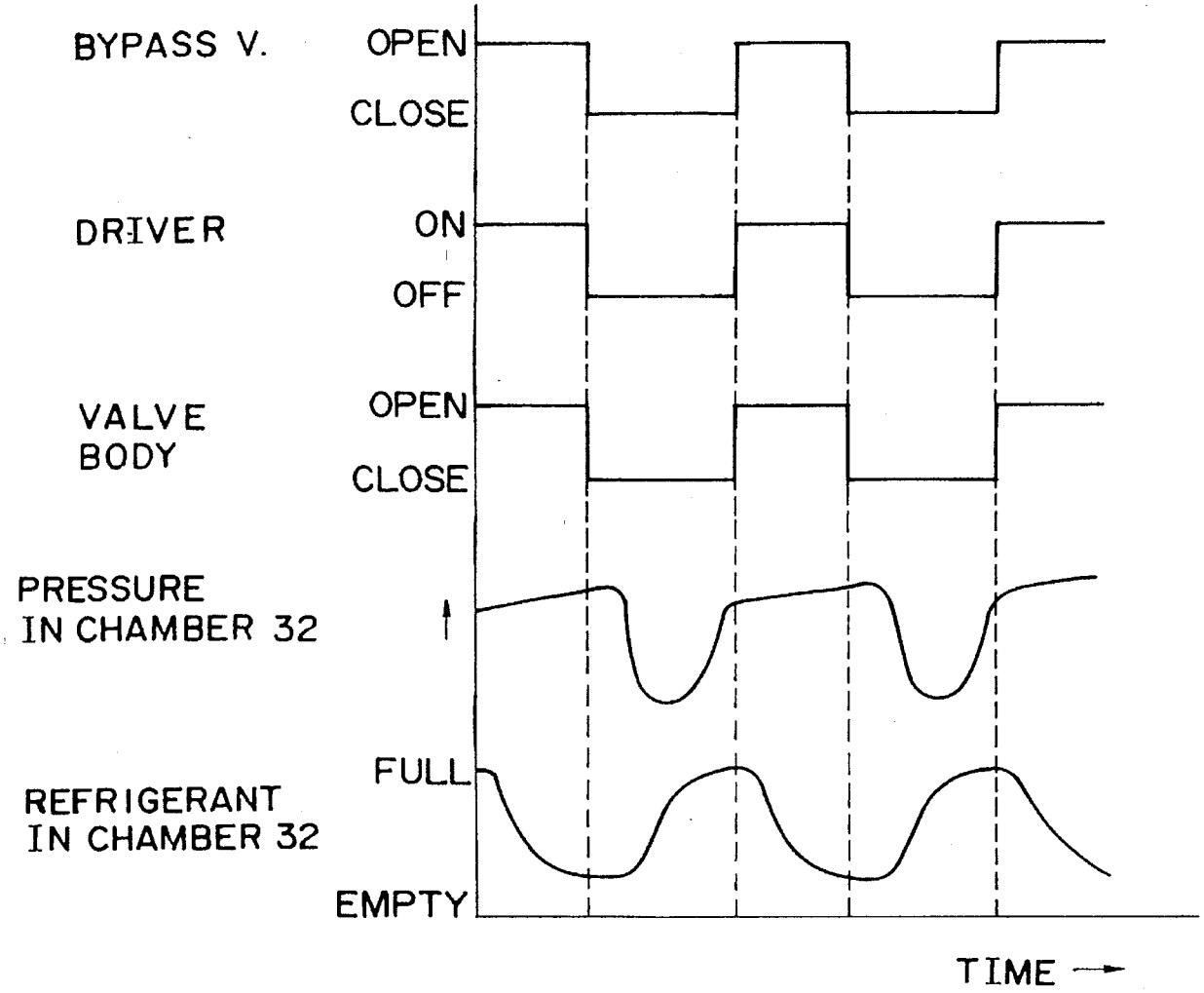
FIG. 7 is a graph showing the operation of the heat transfer apparatus of FIG. 6.

FIG. 7 is a graph similar to FIG. 5, but indicating the pattern of change in pressure inside the liquid-receiving chamber 32 and the pattern of change in amount of the liquid refrigerant in the liquid-receiving chamber 32 with respect to the operation of the driving means 34, that of the valve body 28, and that of the bypass valve 40.

As discussed in connection with the conventional apparatus, it is necessary to adjust the amount of circulation of refrigerant in accordance with the burning amount of the burner 19 and the pressure of the radiator 14. To this end, the ON period during which the bypass valve 40 is opened and the ON duration of the driving means 37 are controlled by the control means 41 based on an output signal of the combustion controller 20 and that of the temperature detector 21 provided on the outlet pipe 6.

The heat transfer apparatus according to the second embodiment brings about not only effects similar to those brought about by that according to the first embodiment of the present invention, but also the following effects.

The bypass pipe 39 having the bypass valve 40 introduces only the gas refrigerant from the gas-liquid separating chamber 24 into the liquid-receiving chamber 32 when the valve body 28 is opened. Thus, gas-liquid replacement operation can be favorably accomplished within a short period of time in dropping the liquid refrigerant contained in the liquid-receiving chamber 32 into the gas-liquid separating chamber 24. That is, the construction shown in FIG. 6 shortens the period of time (one cycle) necessary for suckling the liquid refrigerant from the radiator 14 into the liquid-receiving chamber 32 and dropping the liquid refrigerant from the liquid-receiving chamber 32 into the gas-liquid separating chamber 24, thus increasing the heat transfer performance.

Figure 8:
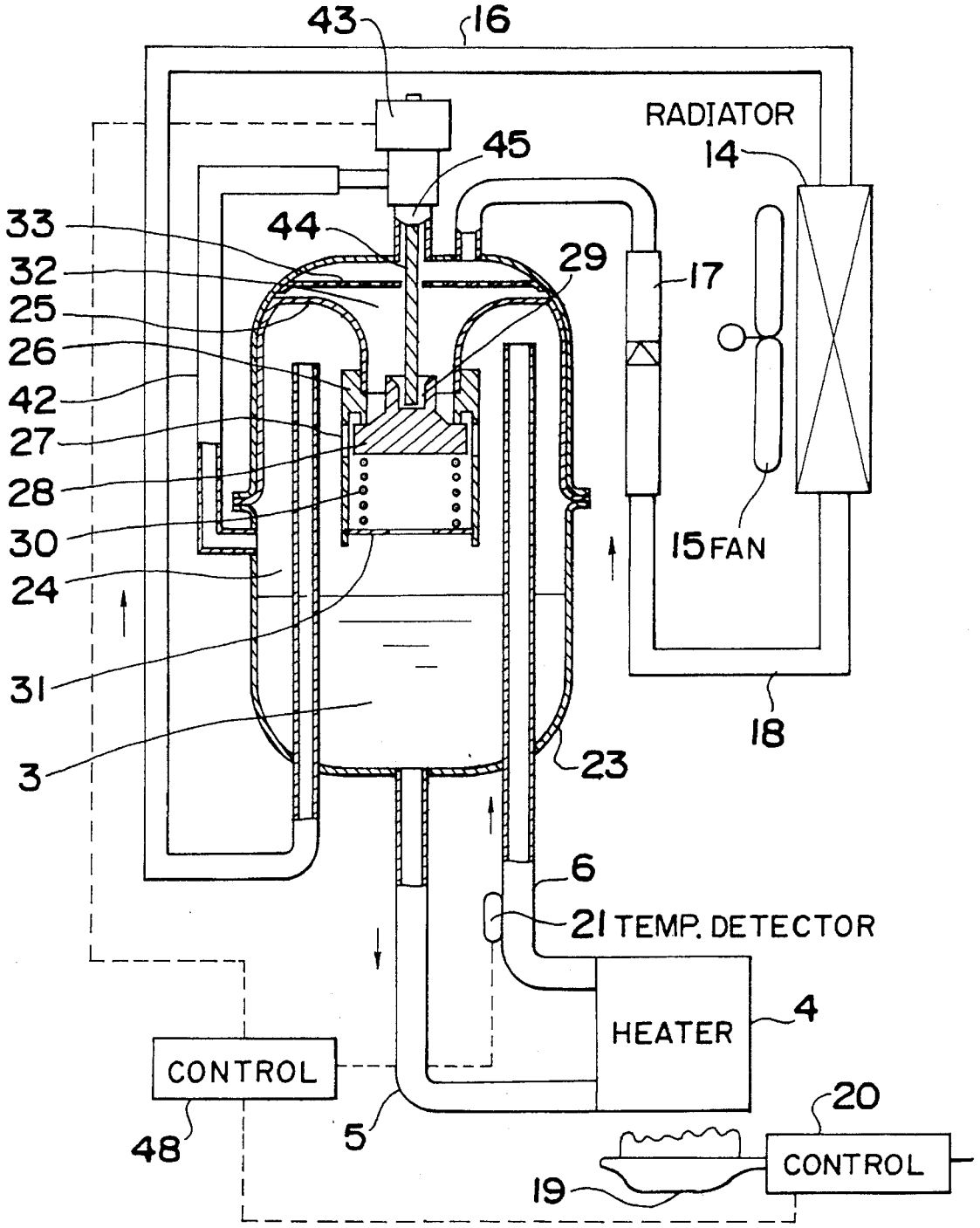
FIG. 8 is a view similar to FIG. 2, but according to a third embodiment of the present invention.
Figure 9:
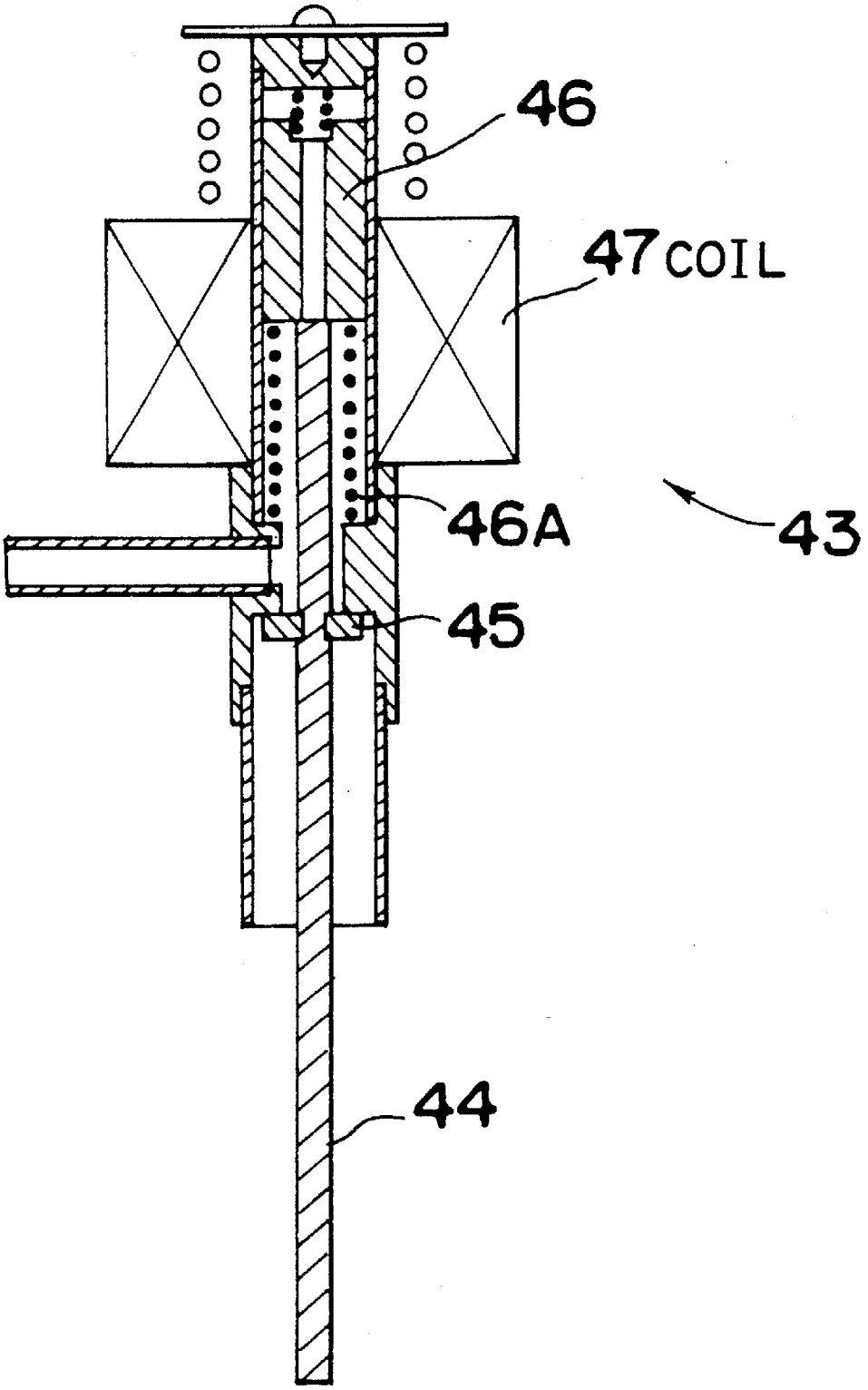
FIG. 9 is a longitudinal sectional view of a driving means provided with a bypass valve and mounted on a container of the heat transfer apparatus of FIG. 8.

FIGS. 8 and 9 depict a heat transfer apparatus according to a third embodiment of the present invention. The difference between the heat transfer apparatus according to the first embodiment and that according to the third embodiment is such that in the third embodiment, as best shown in FIG. 9, a driving means 43 having a bypass valve 45 is employed. That is when an electric coil 47 is energized, a plunger 46 is attracted by the coil 37. As a result, the shaft 44 is pressed downwardly and, hence, the bypass valve 45 fixed to the shaft 44 is pressed downwardly to open. On the other hand, when the coil 47 is deenergized, a spring 46A presses the plunger 46 upwardly and, therefore, the shaft 44 is moved upwardly to thereby close the bypass valve 45.

As shown in FIG. 8, the gas-liquid separating chamber 24 and the portion of the liquid-receiving chamber 32 above the porous plate 33 are communicated with each other via the driving means 43 with the bypass valve, and a bypass pipe 42. The operation of this driving means 43 is controlled by a control means 48 based on an output signal of the combustion controller 20 and that of the temperature detector 21 provided on the outlet pipe 6.

Upon energization of the coil 47 when the liquid-receiving chamber 32 is filled with the liquid refrigerant, the shaft 44 is pressed downwardly to allow the bypass valve 45 to open. At the same time, the shaft 44 is brought into contact with the valve body 28 to open the valve body 28. As a result, the liquid refrigerant in the liquid-receiving chamber 32 flows into the gas-liquid separating chamber 24 through the gas-liquid replacement holes 27 defined in the valve guide 26 due to the replacing action of the gas flow from the gas-liquid separating chamber 24 and the gravitational effect of the liquid refrigerant contained in the liquid-receiving chamber 32. Such liquid refrigerant is eventually stored in the gas-liquid separating chamber 24 as the liquid refrigerant 3. When the coil 47 is deenergized, however, the shaft 44 is moved upwardly and, therefore, not only is the valve body 28 closed by the spring 30, but the bypass valve 45 is also closed. Consequently, the subcooled liquid refrigerant in the radiator 14 flows into the liquid-receiving chamber 32, thus filling the liquid-receiving chamber 32. The above operations are repeatedly performed.

Figure 10:
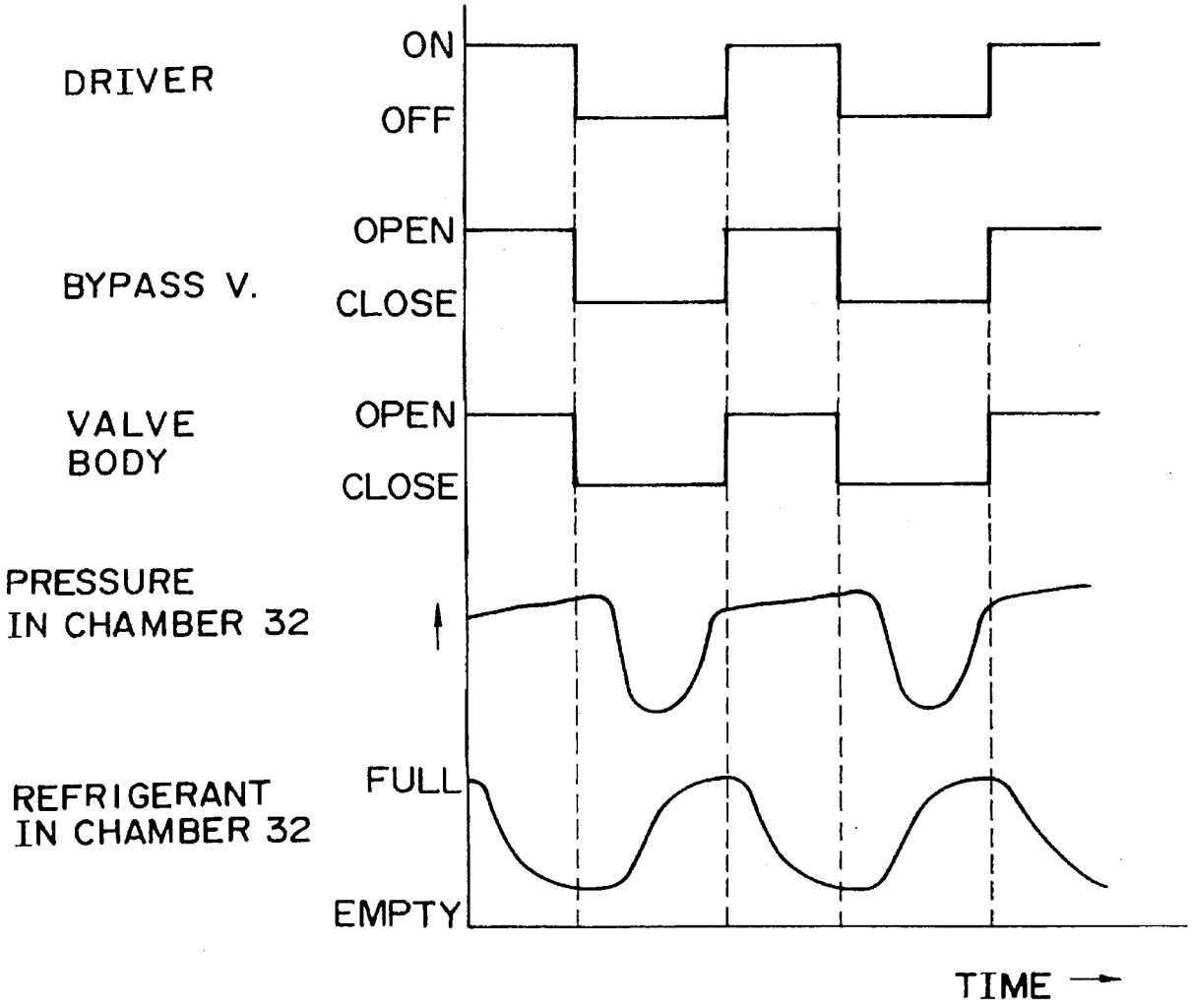
FIG. 10 is a graph showing the operation of the heat transfer apparatus of FIG. 8.

FIG. 10 is a graph similar to FIG. 7, and indicating the pattern of change in pressure inside the liquid-receiving chamber 32 and the pattern of change in amount of the liquid refrigerant in the liquid-receiving chamber 32 with respect to the operation of the driving means 43, that of the valve body 28, and that of the bypass valve 45.

As described previously, in order to adjust the amount of circulation of the refrigerant in accordance with the burning amount of the burner 19 and the pressure of the radiator 14, the coil 47 of the driving means 43 is energized for a predetermined period of time by the control means 48 based on an output signal of the combustion controller 20 and that of the temperature detector 21.

The heat transfer apparatus according to the third embodiment brings about not only effects similar to those brought about by that according to the first embodiment of the present invention, but also the following effects.

The driving means 43 provided with the bypass valve 45 introduces the gas refrigerant from the gas-liquid separating chamber 24 to the liquid-receiving chamber 32 when the valve body 28 is opened. Thus, gas-liquid replacement operation can be accomplished efficiently within a short period of time in dropping the liquid refrigerant in the liquid-receiving chamber 32 into the gas-liquid separating chamber 24. That is, the construction shown in FIG. 8 shortens the period of time (one cycle) necessary for sucking the liquid refrigerant from the radiator 14 to the liquid-receiving chamber 32 and dropping the liquid refrigerant from the liquid-receiving chamber 32 into the gas-liquid separating chamber 24, thus increasing the heat transfer performance.

Figure 11:
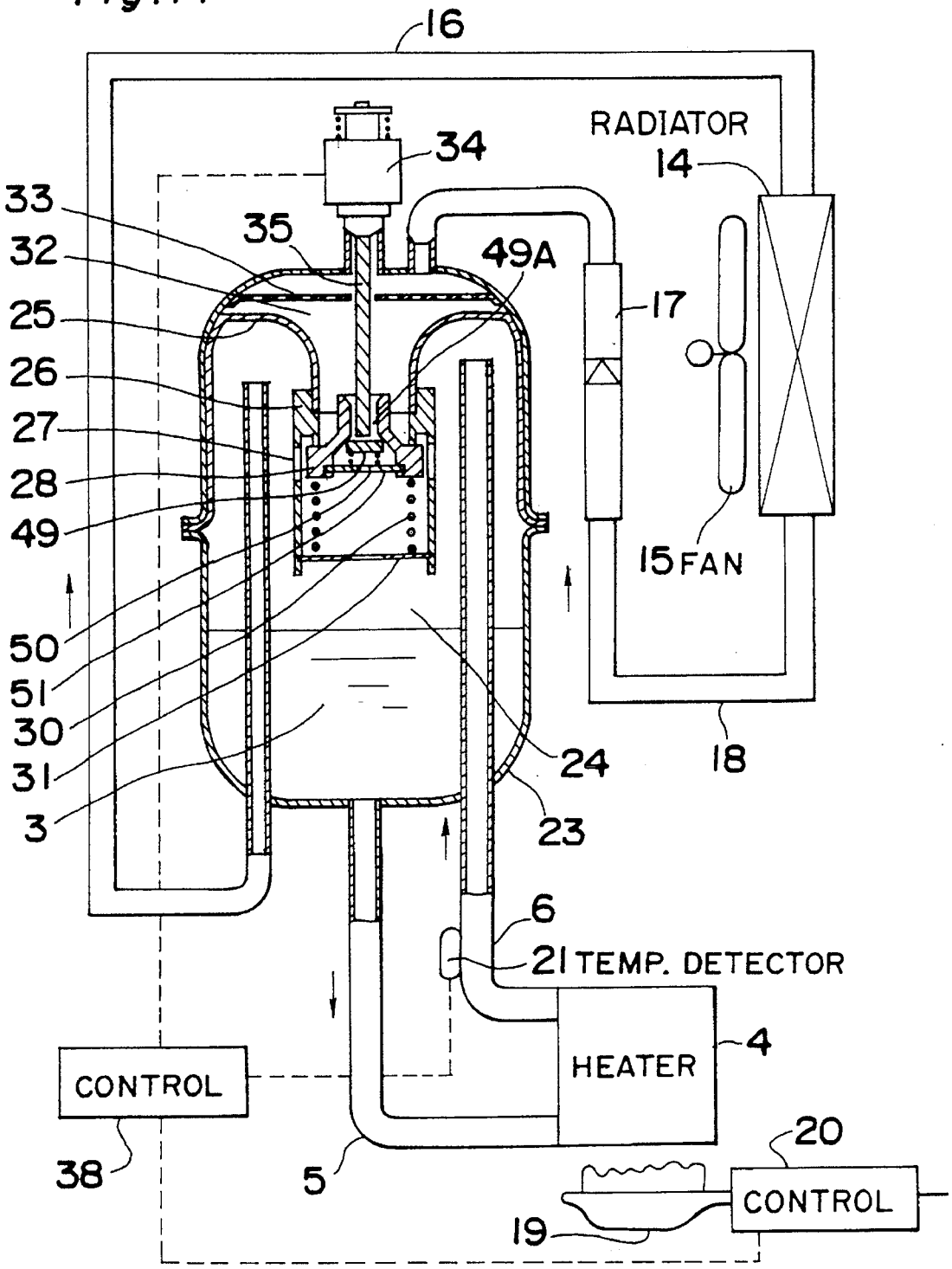
FIG. 11 is a view similar to FIG. 2, but according to a fourth embodiment of the present invention.

FIG. 11 depicts a heat transfer apparatus according to a fourth embodiment of the present invention. The difference between the heat transfer apparatus according to the first embodiment and the heat transfer apparatus according to the fourth embodiment is such that in the fourth embodiment, the valve body 28 is internally provided with a pilot valve 49 for opening and closing an opening 49A defined therein. More specifically, the pilot valve 49 incorporated in the valve body 28 is biased upwardly by a spring 50 supported by a generally horizontally extending spring-supporting member 51 so as to close the opening 49A, the diameter of which is smaller than that of the opening of the valve guide 26 closed by the valve body 28. The pilot valve 49 partitions the liquid-receiving chamber 32 and the gas-liquid separating chamber 24 from each other.

In this construction, when the coil 37 of the driving means 34 is energized, the lower end of the shaft 35 thereof inserted into the opening 49A is brought into contact with the pilot valve 49, thus pressing the pilot valve 49 downwardly and subsequently the valve body 28 downwardly. As a result, the pilot valve 49 and the valve body 28 are sequentially opened. On the other hand, when the coil 37 is deenergized, the spring 36A, the spring 30, and the spring 50 press the shaft 35, the valve body 28, and the pilot valve 49 upwardly, respectively. Consequently, the valve body 28 and the pilot valve 49 are both closed.

Thus, upon energization of the solenoid 37 of the driving means 34 while the liquid-receiving chamber 32 is filled with the liquid refrigerant, the shaft 35 is pressed downwardly, bringing the lower end thereof into contact with the pilot valve 49 to thereby open the pilot valve 49 and the valve body 28 sequentially. As a result of gas-liquid replacement operation performed through the gas-liquid replacement holes 27 of the valve guide 26 and the opening 49A of the pilot valve 49, the liquid refrigerant in the liquid-receiving chamber 32 drops into the gas-liquid separating chamber 24 by the action of its own gravity and is stored in the gas-liquid separating chamber 24 as the liquid refrigerant 3. When the driving means 34 is subsequently deenergized, the shaft 35 is moved upwardly to thereby close both of the pilot valve 49 and the valve body 28. The subcooled liquid refrigerant in the radiator 14 then flows into the liquid-receiving chamber 32, thus filling the liquid-receiving chamber 32. Thereafter, the driving means 34 is energized. In this way, the above operations are repeatedly performed.

The heat transfer apparatus according to the fourth embodiment provides the following effects in addition to the effects brought about by that according to the first embodiment of the present invention.

According to the fourth embodiment of the present invention, the pilot valve 49, which closes the opening 49A smaller in diameter than that closed by the valve body 28, is first pressed downwardly by the shaft 35 to open the opening 49A so that the gas refrigerant may be introduced into the liquid-receiving chamber 32 from the gas-liquid separating chamber 24 to equalize the pressure in the liquid-receiving chamber 32 and that in the gas-liquid separating chamber 24. A subsequent downward movement of the shaft 35 opens the valve body 28. Accordingly, instead of pressing the valve body 28 by the driving means 34 directly, the opening 49A smaller in diameter than the opening closed by the valve body 28 can be opened with a small force by pressing the pilot valve 49 downwardly using the driving means 34. This construction allows the coil 37 to o be compact and thus inexpensive.

Figure 12:
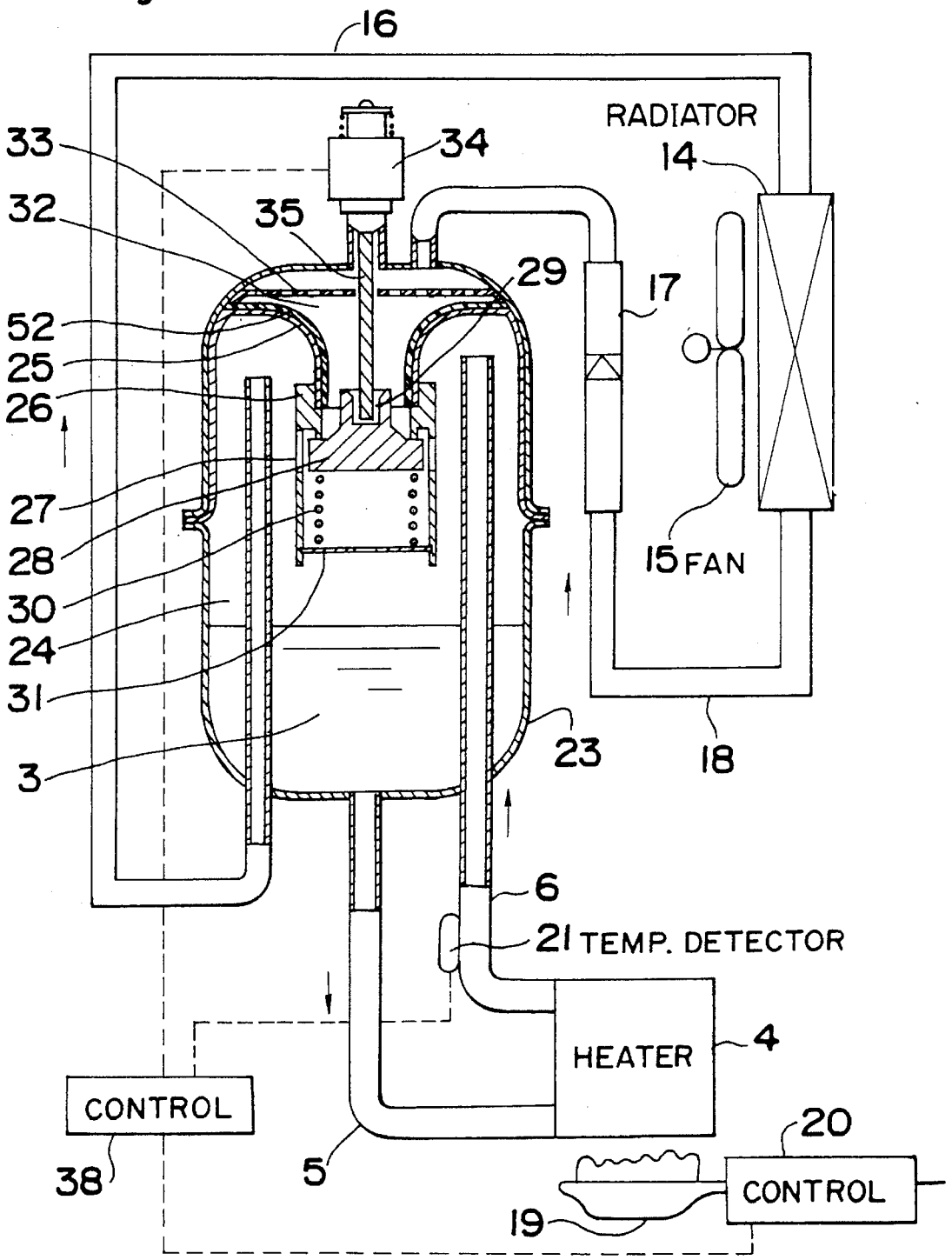
FIG. 12 is a view similar to FIG. 2, but according to a fifth embodiment of the present invention.

FIG. 12 depicts a heat transfer apparatus according to a fifth embodiment of the present invention. The heat transfer apparatus shown in FIG. 12 differs from the heat transfer apparatus according to the first embodiment in that the former is provided with a heat insulation member 52 overlaid on the upper surface of the partitioning plate 25. The heat insulation member 52 is preferably made of molded resin such as Teflon or nylon. This construction prevents heat of saturated refrigerant of a high temperature accommodated in the gas-liquid separating chamber 24from being transferred to the liquid-receiving chamber 32 through the partitioning plate 25.

The heat transfer apparatus according to the fifth embodiment provides the following additional effects.

When the liquid refrigerant condensed and subcooled by the radiator 14 flows into the liquid-receiving chamber 32 with the valve body 28 closed, the degree to which the liquid refrigerant cools the partitioning plate 25 is reduced, and most of the cooling performance thereof is hence used to cool the gas refrigerant in the liquid-receiving chamber 32. Thus, the pressure in the liquid-receiving chamber 32 can be reduced considerably and, accordingly, it is possible to shorten the period of time within which the liquid-receiving chamber 32 is filled with the liquid refrigerant, thus reducing the ON duration of the driving means 34.

Thus, the construction according to the fifth embodiment of the present invention can shorten the period of time (one cycle) necessary for reducing the pressure in the liquid-receiving chamber 32, sucking the liquid refrigerant from the radiator 14 into the liquid-receiving chamber 32, and dropping the liquid refrigerant from the liquid-receiving chamber 32 to the gas-liquid separating chamber 24. This increases the amount of circulation of the refrigerant and, hence, increases the amount of heat to be transferred.

Figure 13:
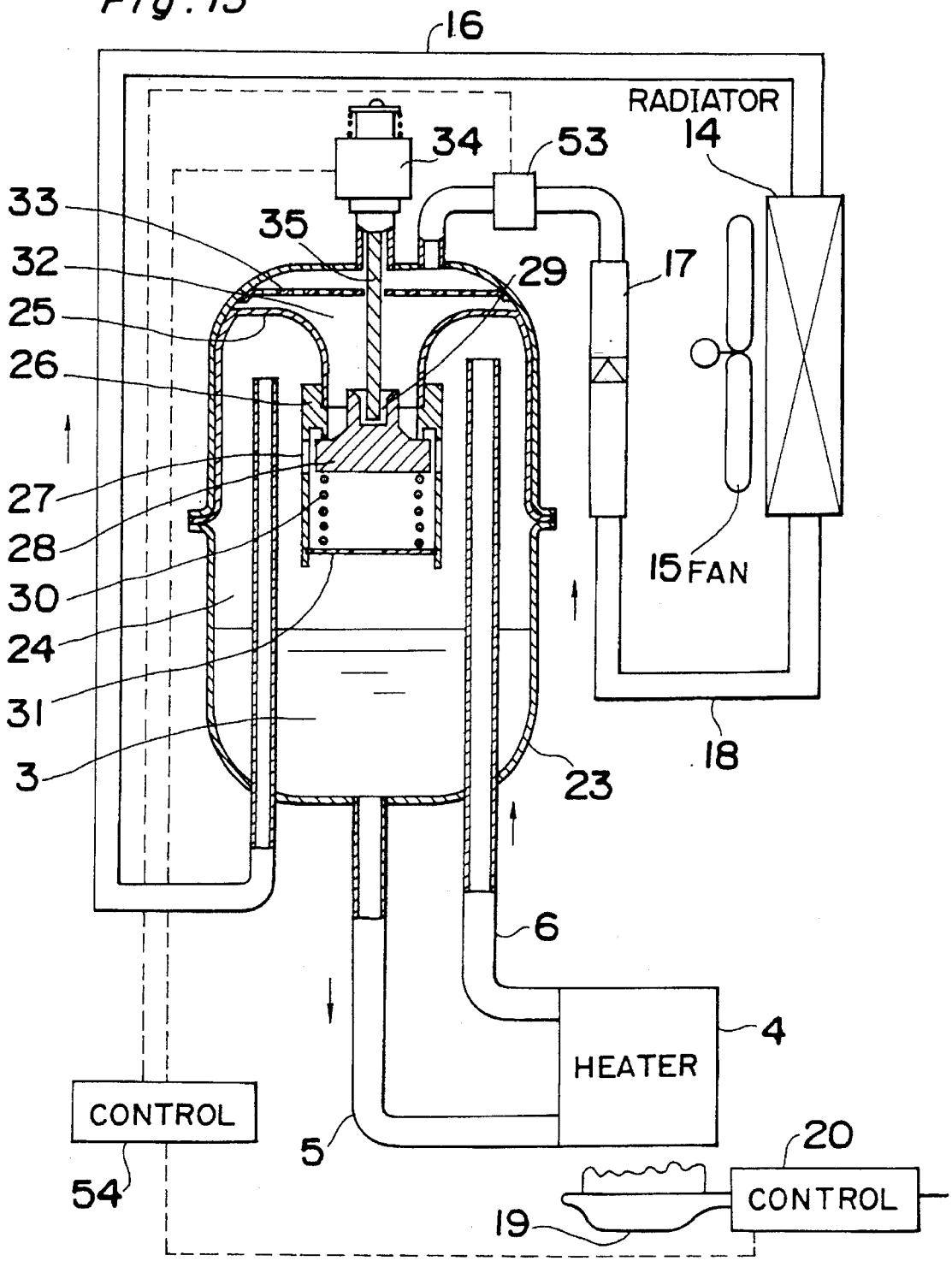
FIG. 13 is a view similar to FIG. 2, but according to a sixth embodiment of the present invention.

FIG. 13 depicts a heat transfer apparatus according to a sixth embodiment of the present invention. The difference between the heat transfer apparatus according to the first embodiment and the heat transfer apparatus according to the sixth embodiment is such that the sixth embodiment employs a pressure detector 53 for detecting the completion of the operation of sucking the liquid refrigerant from the radiator 14 into the liquid-receiving chamber 32 and, also, a control means 54 for controlling the operation of the driving means based on an output signal of the combustion controller 20 and that of the pressure detector 53.

As is apparent from the description made previously with reference to FIG. 5, the amount of the liquid refrigerant in the liquid-receiving chamber 32 increases with a rapid reduction in pressure in the liquid-receiving chamber 32 from the pressure shown by the point (P) to the pressure shown by the point (Q). At this time, the liquid refrigerant flows through the liquid-return pipe 18 and, hence, the pressure therein drops. When the liquid-receiving chamber 32 is filled with the liquid refrigerant, the flow of the liquid refrigerant stops. Consequently, the pressure in the liquid-receiving chamber 32 returns to the pressure indicated by the point (R) and, likewise, the pressure in the liquid-return pipe 18 returns to the pressure indicated by the point (R).

In view of the foregoing, the pressure detector 53 may be installed on the liquid-receiving chamber 32 or on the liquid-return pipe 18. In FIG. 13, the pressure detector 53 is installed on the liquid-return pipe 18.

The temperature detector 21 provided in the first embodiment can be eliminated from the heat transfer apparatus according to the sixth embodiment, because the pressure detector 53 directly detects the pressure (pressure shown by the point (Q) or (R)) close to the pressure inside the radiator 14. In order to adjust the amount of circulation of the refrigerant in accordance with the burning amount of the burner 19 and the pressure in the radiator 14, the driving means 34 is controlled by the control means 54 based on an output signal of the combustion controller 20 and that of the pressure detector 53.

Although the period of time required to feed the liquid refrigerant from the radiator 14 into the liquid-receiving chamber 32 has been conventionally set to a comparatively long time, assuming that the conventional apparatus may have a long liquid-return pipe that communicates the radiator 14 with the liquid-receiving chamber 32, the sixth embodiment of the present invention can shorten the period of time required to introduce the liquid refrigerant into the liquid-receiving chamber 32 from the radiator 14 depending on the length of the liquid-return pipe 18. That is, the construction shown in FIG. 13 can shorten the period of time for reducing the pressure inside the liquid-receiving chamber 32, sucking the liquid refrigerant from the radiator 14 into the liquid-receiving chamber 32, and dropping the liquid refrigerant from the liquid-receiving chamber 32 to the gas-liquid separating chamber 24, thus increasing the amount of heat to be transferred.

Although, in the above-described embodiments, the heat transfer apparatus is provided with a single container 1 accommodating the valve body 28, the heat transfer apparatus may be provided with two containers directly joined to each other.

Figure 14:
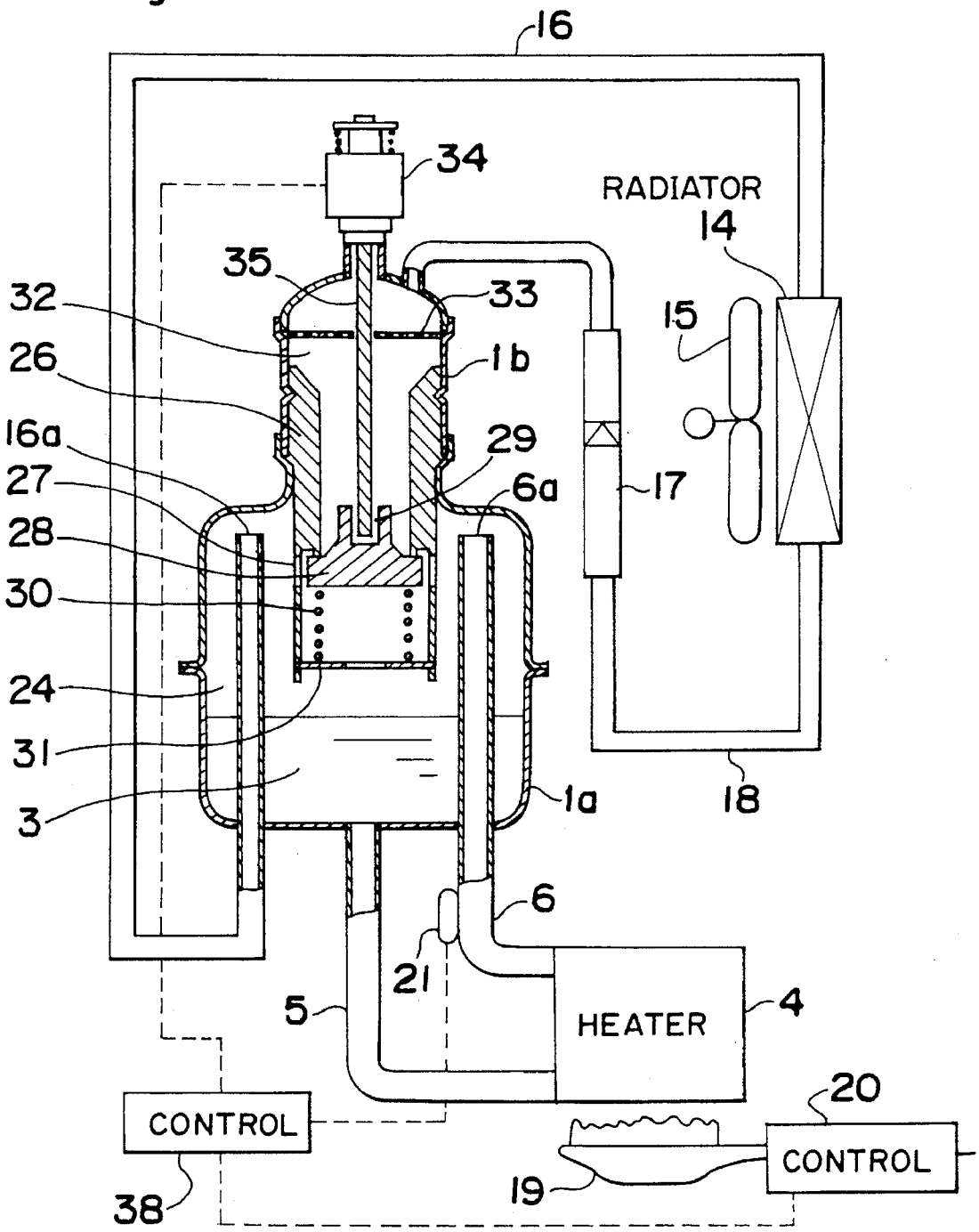
FIG. 14 is a view similar to FIG. 2, but according to a seventh embodiment of the present invention.

More specifically, as shown in FIG. 14, a heat transfer apparatus according to a seventh embodiment of the present invention comprises a first container 1*a* disposed above the refrigerant heater 4 and having a gas-liquid separating chamber 24 defined therein, and a second container 1*b* directly joined to an upper portion of the first container 1*a* and having a liquid-receiving chamber defined therein. The second container 1*b* accommodates a generally horizontally extending porous plate 33 secured thereto. A cylindrical valve guide 26 is secured to either the first container 1*a* or the second container 1*b*, and accommodates a vertically movable valve body 28, which is biased upwardly by a spring 30 interposed between it and a spring-supporting plate 31 secured to the lower end of the valve guide 26. The valve body 28 selectively opens and closes an opening defined between the first and second containers 1*a* and 1*b*.

Because the other structure and the operation of the heat transfer apparatus shown in FIG. 14 are the same as those of the heat transfer apparatus according to the first embodiment of the present invention, a description thereof has been omitted for brevity's sake. $I_o$ Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A heat transfer apparatus having a heating circuit and a heat release circuit comprising:

a refrigerant heater;

a first container disposed above said refrigerant heater and having a gas-liquid separating chamber defined therein;

a second container directly joined to an upper portion of said first container and having a liquid-receiving chamber defined therein;

a valve body for selectively opening and closing an opening defined between said first and second containers, said valve body and said opening being disposed within one of said first and second containers;

a driving means for driving said valve body;

a radiator spaced from said first container;

a first communication means for communicating said refrigerant heater and said gas-liquid separating chamber;

a second communication means for communicating said gas-liquid separating chamber, said radiator, and said liquid-receiving chamber;

said refrigerant heater, said gas-liquid separating chamber, and said first communication means constituting said heating circuit; and said gas-liquid separating chamber, said radiator, said liquid-receiving chamber, said valve body, said second communication means constituting said heat release circuit.

2. A heat transfer apparatus having a heating circuit and a heat release circuit comprising:

a refrigerant heater;

a single container disposed above said refrigerant heater;

a partitioning plate accommodated in said container for separating an inside of said container into a gas-liquid separating chamber and a liquid-receiving chamber;

a valve body for selectively opening and closing an opening defined in said partitioning plate;

a driving means for driving said valve body;

a radiator spaced from said container;

a first communication means for communicating said refrigerant heater and said gas-liquid separating chamber;

a second communication means for communicating said gas-liquid separating chamber, said radiator, and said liquid-receiving chamber;

said refrigerant heater, said gas-liquid separating chamber, and said first communication means constituting said heating circuit; and said gas-liquid separating chamber, said radiator, said liquid-receiving chamber, said valve body, and said second communication means constituting said heat release circuit.

3. The heat transfer apparatus according to claim 2, wherein said first communication means comprises a first pipe to allow refrigerant to flow from said refrigerant heater to said gas-liquid separating chamber, and said second communication means comprises a second pipe to allow said refrigerant to flow from said gas-liquid separating chamber to said radiator, and wherein said first and second pipes are open in said gas-liquid separating chamber and have respective openings higher than said valve body.

4. The heat transfer apparatus according to claim 2, wherein said driving means has an electrically vertically movable shaft to open said opening of said partitioning plate.

5. The heat transfer apparatus according to claim 2, further comprising a bypass pipe and a bypass valve both mounted on said container, and a controller for controlling said bypass valve and said driving means in synchronism with each other, said bypass pipe and said bypass pipe communicating said gas-liquid separating chamber and said liquid-receiving chamber with each other.

6. The heat transfer apparatus according to claim 2, further comprising a bypass pipe mounted on said container, wherein said driving means is mounted on said container and comprises a bypass valve accommodated in said driving means, said bypass pipe and said bypass valve communicating said gas-liquid separating chamber and said liquid-receiving chamber with each other.

7. The heat transfer apparatus according to claim 2, further comprising a pilot valve accommodated in said valve body, said pilot valve selectively opening and closing an opening defined in said valve body, said driving means driving both said pilot valve and said valve body.

8. The heat transfer apparatus according to claim 2, further comprising a heat insulation member overlaid on said partitioning plate.

9. The heat transfer apparatus according to claim 2, further comprising a pressure detector for detecting a pressure inside said liquid-receiving chamber and a controller for controlling said driving means in response to an output signal from said pressure detector.

10. The heat transfer apparatus according to claim 2, wherein said second communication means comprises a third pipe for communicating said radiator and said liquid-receiving chamber with each other, and further comprising a pressure detector for detecting a pressure inside said third pipe and a controller for controlling said driving means in response to an output signal from said pressure detector.

* * * * *